US012038171B2

(12) United States Patent
Jeong et al.

(10) Patent No.: US 12,038,171 B2
(45) Date of Patent: Jul. 16, 2024

(54) FUEL SUPPLY DEVICE OF CIRCULATING FLUIDIZED BED BOILER

(71) Applicant: HYUNDAI HEAVY INDUSTRIES POWER SYSTEMS CO., LTD., Gyeonggi-do (KR)

(72) Inventors: Jin Yeoung Jeong, Gyeonggi-do (KR); Kyu Jong Kim, Gyeonggi-do (KR)

(73) Assignee: HYUNDAI HEAVY INDUSTRIES POWER SYSTEMS CO., LTD., Gyeonggi-Do (KR)

( * ) Notice: Subject to any disclaimer, the term of this patent is extended or adjusted under 35 U.S.C. 154(b) by 431 days.

(21) Appl. No.: 17/299,780

(22) PCT Filed: May 9, 2019

(86) PCT No.: PCT/KR2019/005587
§ 371 (c)(1),
(2) Date: Jun. 3, 2021

(87) PCT Pub. No.: WO2020/116726
PCT Pub. Date: Jun. 11, 2020

(65) Prior Publication Data

US 2022/0018533 A1 Jan. 20, 2022

(30) Foreign Application Priority Data

Dec. 6, 2018 (KR) ..... 10-2018-0156376

(51) Int. Cl.
*F23C 10/22* (2006.01)
*F22B 31/00* (2006.01)
*F23C 7/00* (2006.01)

(52) U.S. Cl.
CPC ..... *F23C 10/22* (2013.01); *F22B 31/0007* (2013.01); *F23C 7/00* (2013.01)

(58) Field of Classification Search
CPC ..... F23C 10/22; F23C 10/005; F23C 10/00; F23C 10/002; F23C 10/007; F23C 10/01;
(Continued)

(56) References Cited

U.S. PATENT DOCUMENTS 3,863,577 A 2/1975 Steever et al.
4,823,712 A * 4/1989 Wormer ..... F23G 5/04 110/263
2017/0350593 A1* 12/2017 Desellem ..... C08L 97/02

FOREIGN PATENT DOCUMENTS

JP 2004-85064 3/2004
JP 2013-245890 12/2013
(Continued)

OTHER PUBLICATIONS

International Search Report for PCT/KR2019/005587 dated Aug. 27, 2019 and its English translation from WIPO (now published as WO 2020/116726).
(Continued)

*Primary Examiner* — Vivek K Shirsat
(74) *Attorney, Agent, or Firm* — Ladas & Parry, LLP

(57) ABSTRACT

The present invention relates to a fuel supply device of a circulating fluidized bed boiler. The fuel supply device includes: a feeder transferring fuel; a chute extending downwardly inclined from a lower end portion of the feeder to a combustor, the chute supplying the fuel to the combustor through a fuel injection hole; and a combustion heat blocking part provided at a portion of the fuel injection hole, the combustion heat blocking part preventing the fuel from being melted or burned at an end of the fuel injection hole connected to the combustor and in the fuel injection hole due to back fire. The combustion heat blocking part includes a heat shield plate installed at a sidewall of the combustor at an upper side of the fuel injection hole.

6 Claims, 4 Drawing Sheets

(58) Field of Classification Search
CPC ..... F23C 10/02; F23C 10/12; F23C 10/04; F23C 10/06; F23C 10/18; F23C 10/10; F23C 10/14; F23C 10/16; F23C 10/20; F23C 10/24; F23C 10/28; F23C 10/30; F23C 10/32; F23C 7/00; F22B 31/0007
USPC ..... 431/7, 170; 422/139; 110/245
See application file for complete search history.

(56) References Cited

FOREIGN PATENT DOCUMENTS

| | | |
|---|---|---|
| JP | 2017-215059 | 12/2017 |
| KR | 10-2013-0123601 | 11/2013 |

OTHER PUBLICATIONS

Written Opinion of the International Searching Authority for PCT/KR2019/005587 dated Aug. 27, 2019 and its English translation by Google Translate (now published as WO 2020/116726).
Kim, Kyu Jong et al.: "Application and Operating Experience of High Sulfur Fuels in Circulating Fluidized Bed Boliers", In 23rd International Conference on FBC. May 2018. See p. 1162 and figure 6.

* cited by examiner

FUEL SUPPLY DEVICE OF CIRCULATING FLUIDIZED BED BOILER

CROSS-REFERENCE TO RELATED APPLICATIONS

The present application is the U.S. National Phase of PCT Application No. PCT/KR2019/005587 filed on May 9, 2019, which claims the priority to Korean Patent Application No. 10-2018-0156376 filed on Dec. 6, 2018, the entire contents of which are incorporated herein by reference.

TECHNICAL FIELD

The present invention relates to a fuel supply device of a circulating fluidized bed boiler.

BACKGROUND ART

A circulating fluidized bed boiler is generally divided into a circulating fluidized bed combustor, a high temperature separator, and a device for returning particles to the combustor. Also, the circulating fluidized bed boiler is divided into an external circulating fluidized bed heat exchanger and a fuel supply device according to a boiler type.

The circulating fluidized bed boiler has many advantages as compared as other solid fuel combustion boilers.

In particular, the diversity of fuel is one of very important advantages. The circulating fluidized bed boiler can use, as fuel, low-grade lignite, oil shale, petroleum coke, petroleum pitch, wood waste, urban waste, other industrial wastes, and the like, including coal having high sulfur and ash due to excellent mixture of gas-solid and solid-solid. In particular, the circulating fluidized bed boiler can burn low calorie fuel without any other auxiliary fuel.

The fuel supply device of the circulating fluidized bed boiler may include a feeder which is provided at the outside of a combustor and is connected to a length upper portion of a chute to transfer fuel to the chute, and the chute connected downwardly inclined from a lower end portion of the feeder to the combustor.

The fuel input from the feeder and the chute is supplied to the inside of the combustor through a fuel injection hole of the chute located inclined.

However, when fuel is supplied, which has a low melting point, such as Refuse Plastic Fuel (RPF), Refuse Derived Fuel (RDF), or petroleum pitch, which is manufactured by mixing and solidifying sludge as waste and waste plastic, back fire occurs at a portion of the fuel injection hole of the chute connected to the combustor, or the fuel is melted and then stuck to the portion of the fuel injection hole. Therefore, the fuel injection hole may be clogged. In a case where trouble is caused as the fuel injection hole is locally clogged, the driving workload of the circulating fluidized bed boiler should be lowered. In a severe case, the circulating fluidized bed boiler should be stopped, which results in degradation of availability.

DISCLOSURE

Technical Problem

The present invention is conceived to solve the aforementioned problems. Accordingly, an object of the present invention is to provide a fuel supply device of a circulating fluidized bed boiler, which prevents a fuel injection hole from being clogged as fuel having a low melting point is melted by heat of a high-temperature combustor or prevents the fuel from being melted or burned at an end of the fuel injection hole connected to the combustor or in the fuel injection hole due to back fire, so that continuous driving of the circulating fluidized bed boiler is possible in a workload being driven, and availability is not be degraded as the continuous driving is possible.

Technical Solution

In accordance with an aspect of the present invention, there is provided a fuel supply device of a circulating fluidized bed boiler, including: a feeder transferring fuel; a chute extending downwardly inclined from a lower end portion of the feeder to a combustor, the chute supplying the fuel to the combustor through a fuel injection hole; and a combustion heat blocking part provided at a portion of the fuel injection hole, the combustion heat blocking part preventing the fuel from being melted or burned at an end of the fuel injection hole connected to the combustor and in the fuel injection hole due to back fire, wherein the combustion heat blocking part includes a heat shield plate installed at a sidewall of the combustor at an upper side of the fuel injection hole.

Specifically, the heat shield plate may be formed in a dome shape having a lower semicircle of the fuel injection hole, which is opened, while covering an upper semicircle of the fuel injection hole, or a fence shape having a downward slope along an edge of the upper semicircle of the fuel injection hole.

Specifically, the combustion heat blocking part may further include air nozzle part installed at the sidewall of the combustor at a lower side of the fuel injection hole.

Specifically, the air nozzle part may include: a plurality of nozzles spraying cooling air into the combustor; a compressor supplying the compressed high-pressure cooling air; and a pipe connecting the nozzles and the compressor to each other.

Specifically, the plurality of nozzles may be installed along the circumference of the lower end portion of the fuel injection hole of the chute connected to the combustor.

Specifically, the combustion heat blocking part may further include a jump stand installed at the sidewall of the combustor at the lower side of the fuel injection hole, the jump stand allowing the fuel injected into the combustor to be spread.

Advantageous Effects

In the fuel supply device of the circulating fluidized bed boiler in accordance with the present invention, the heat shield plate is configured with refractory for blocking high-temperature heat at an upper portion of the fuel injection hole such that heat of the high-temperature combustor is not transferred to the fuel injection hole of the chute. Thus, the fuel injection hole can be prevented from being clogged by fuel having a low melting point, which is melted by the heat of the high-temperature combustor, or combustion can be prevented from occurring at the end of the fuel injection hole connected to the combustor and in the fuel injection hole due to back fire. Accordingly, continuous driving of the circulating fluidized bed boiler is possible, and degradation of availability can be prevented.

Also, in the fuel supply device of the circulating fluidized bed boiler in accordance with the present invention, the air nozzle part is further configured at a lower portion of the fuel injection hole of the chute such that the heat of the high-temperature combustor is not transferred to the fuel injection hole. Thus, the fuel injection hole can be further prevented from being clogged by fuel having a low melting point, which is melted by the heat of the high-temperature combustor, or combustion can be further prevented from occurring at the end of the fuel injection hole connected to the combustor and in the fuel injection hole due to back fire. Accordingly, the continuous driving of the circulating fluidized bed boiler is possible, and the degradation of availability can be prevented.

Also, in the fuel supply device of the circulating fluidized bed boiler in accordance with the present invention, the jump stand is further configured at the lower portion of the fuel injection hole of the chute such that the heat of the high-temperature combustor is not transferred to the fuel injection hole, to help fuel having a low melting point to be well-spread into the high-temperature combustor. Thus, a driving trouble of the circulating fluidized bed boiler can be prevented, and the efficiency of combustion can be improved.

MODE FOR THE INVENTION

Figure 1:
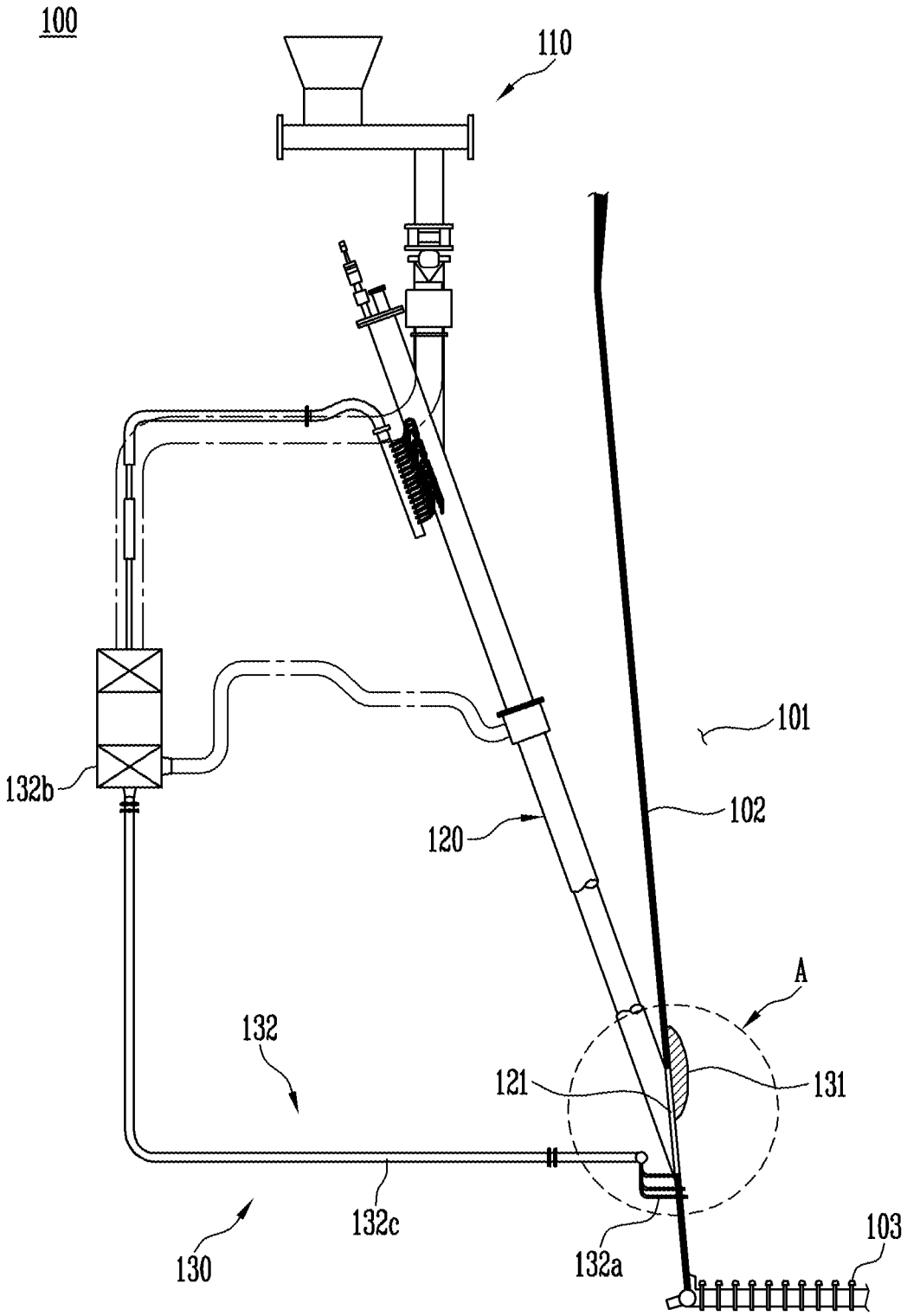
FIG. 1 is a conceptual view representing a fuel supply device of a circulating fluidized bed boiler in accordance with a first embodiment of the present invention.

Other objects, specific advantages, and new features of the present invention will be more apparent from preferable embodiments and the following detailed description associated with the accompanying drawings. In the specification, when reference numerals are endowed to components in each drawing, it should be noted that like reference numerals denote like elements even though they are depicted in several drawings. Further, in the following description of the present invention, a detailed explanation of known related technologies may be omitted to avoid unnecessarily obscuring the subject matter of the present invention.

Hereinafter, exemplary embodiments of the present invention will be described in detail with reference to the accompanying drawings.

Figure 2:
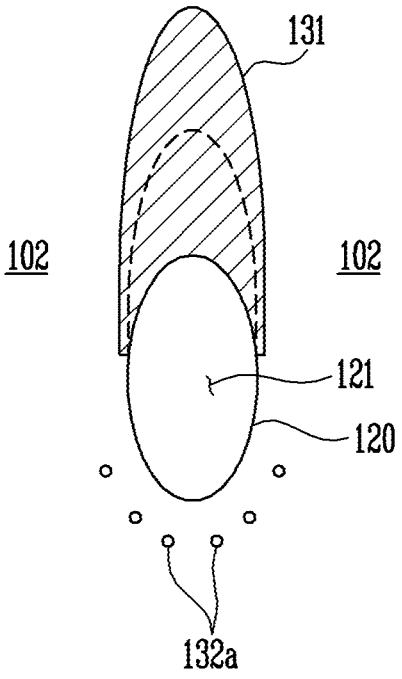
FIG. 2 is an enlarged side view of portion "A" shown in FIG. 1.

FIG. 1 is a conceptual view representing a fuel supply device of a circulating fluidized bed boiler in accordance with a first embodiment of the present invention. FIG. 2 is an enlarged side view of portion "A" shown in FIG. 1.

As shown in FIGS. 1 and 2, the fuel supply device 100 of the circulating fluidized bed boiler in accordance with the first embodiment of the present invention includes a feeder 110, a chute 120, and a combustion heat blocking part 13.

The feeder 110 may be provided at the outside of a combustor 101, and be connected to a length upper end portion of the chute 120, which will be described later, to inject stored fuel to the chute 120.

The fuel may be fuel having a low melting point, such as Refuse Plastic Fuel (RPF) or Refuse Derived Fuel (RDF), which is manufacture by mixing and solidifying sludge as waste and waste plastic. In addition, the fuel may be fuel manufactured as low-grade lignite, oil shale, petroleum coke, petroleum pitch, wood waste, urban waste, other industrial wastes, and the like, including coal having high sulfur and ash due to excellent mixture of gas-solid and solid-solid.

The chute 120 may extend downwardly inclined from a lower end portion of the feeder 110 to the combustor 101, to supply the fuel to the combustor 101. The fuel injected from the feeder 110 to the chute 120 may be supplied to the inside of the combustor 101 through a fuel injection hole 121 of the chute 120 located inclined.

The fuel injection hole 121 may have an elliptical shape extending vertically long.

When fuel having a low melting point is supplied, such as such as Refuse Plastic Fuel (RPF), Refuse Derived Fuel (RDF), or petroleum pitch, which is manufactured by mixing and solidifying sludge as waste and waste plastic, back fire occurs at a portion of the fuel injection hole 121 of the chute 120 connected to the combustor 101, or the fuel is melted and then stuck to a portion of the fuel injection hole 121. In this embodiment, the combustion heat blocking part 130 which will be described below is provided, so that a phenomenon in which the fuel injection hole 121 is clogged can be fundamentally prevented.

The combustion heat blocking part 130 may be provided at the portion of the fuel injection hole 121 to prevent, in advance, the fuel from being melted or burned at an end of the fuel injection hole 121 connected to the combustor 101 and in the fuel injection hole 121 due to the back fire, when the fuel is injected into the high-temperature combustor 101 through the chute 120. The combustion heat blocking part 130 may include a heat shield plate 131 and an air nozzle part 132.

The heat shield plate 131 may be installed at a sidewall 102 of the combustor 101 at an upper side of the fuel injection hole 121 such that heat of the high-temperature combustor 101 is not transferred to the fuel injection hole 121.

The heat shield plate 131 may be formed in various shapes including a dome shape having a lower semicircle of the fuel injection hole 121, which is opened, while covering an upper semicircle of the fuel injection hole 121, a fence shape having a downward slope along an edge of the upper semicircle of the fuel injection hole 121, and the like. The heat shield plate may be formed of refractory strong against heat.

The air nozzle part 132 may be installed at the sidewall 102 of the combustor 101 at a lower side of the fuel injection hole 121 such that the heat of the high-temperature combustor 101 is not transferred to the lower semicircle of the fuel injection hole 121. Only the above-described heat shield plate 131 can prevent the heat of the high-temperature combustor 101 from being transferred to the fuel injection hole 121. However, since the lower semicircle of the fuel injection hole 121 is opened, the heat may be transferred to the lower semicircle of the fuel injection hole 121. The air nozzle part 132 can prevent this heat transfer.

The air nozzle part 132 may be mounted on the sidewall 102 of the combustor 101. The air nozzle part 132 may include a plurality of nozzles 132*a* spraying cooling air into the combustor 101, a compressor 132*b* supplying the compressed high-pressure cooling air, and a pipe 132*c* connecting the nozzles 132*a* and the compressor 132*b* to each other. The plurality of nozzles 132*a* may be installed along the circumference of a lower end portion of the fuel injection hole 121 of the chute 120 connected to the combustor 101.

The above-described air nozzle part 132 may not only function to allow the heat of the high-temperature combustor 101 not to be transferred to the lower semicircle of the fuel injection hole 121, but also function to allow the fuel coming down along the chute 120 to be scattered and widely supplied to the inside of the combustor 101 while colliding with high-pressure air sprayed at the circumference of the lower end portion of the chute 120 at the moment at which the fuel falls into the combustor 101. Thus, the bottom of the combustor 101 or the air nozzles 103 installed at the bottom can be prevented from being damaged due to a local temperature increase as the fuel is burned while falling down to the bottom of the combustor 101 in a restricted area, temperature can be prevented from locally increasing due to combustion as the fuel is uniformly dispersed, and the efficiency of combustion can be improved.

As described above, in the fuel supply device 100 of the circulating fluidized bed boiler, when fuel having a low melting point is supplied, such as such as Refuse Plastic Fuel (RPF), Refuse Derived Fuel (RDF), or petroleum pitch, continuous driving of the circulating fluidized bed boiler is possible without any driving trouble of the fuel injection hole 121, which is caused by clogging of the fuel injection hole 121 due to melted fuel or high temperature due to back fire. Accordingly degradation of availability can be prevented.

Figure 3:
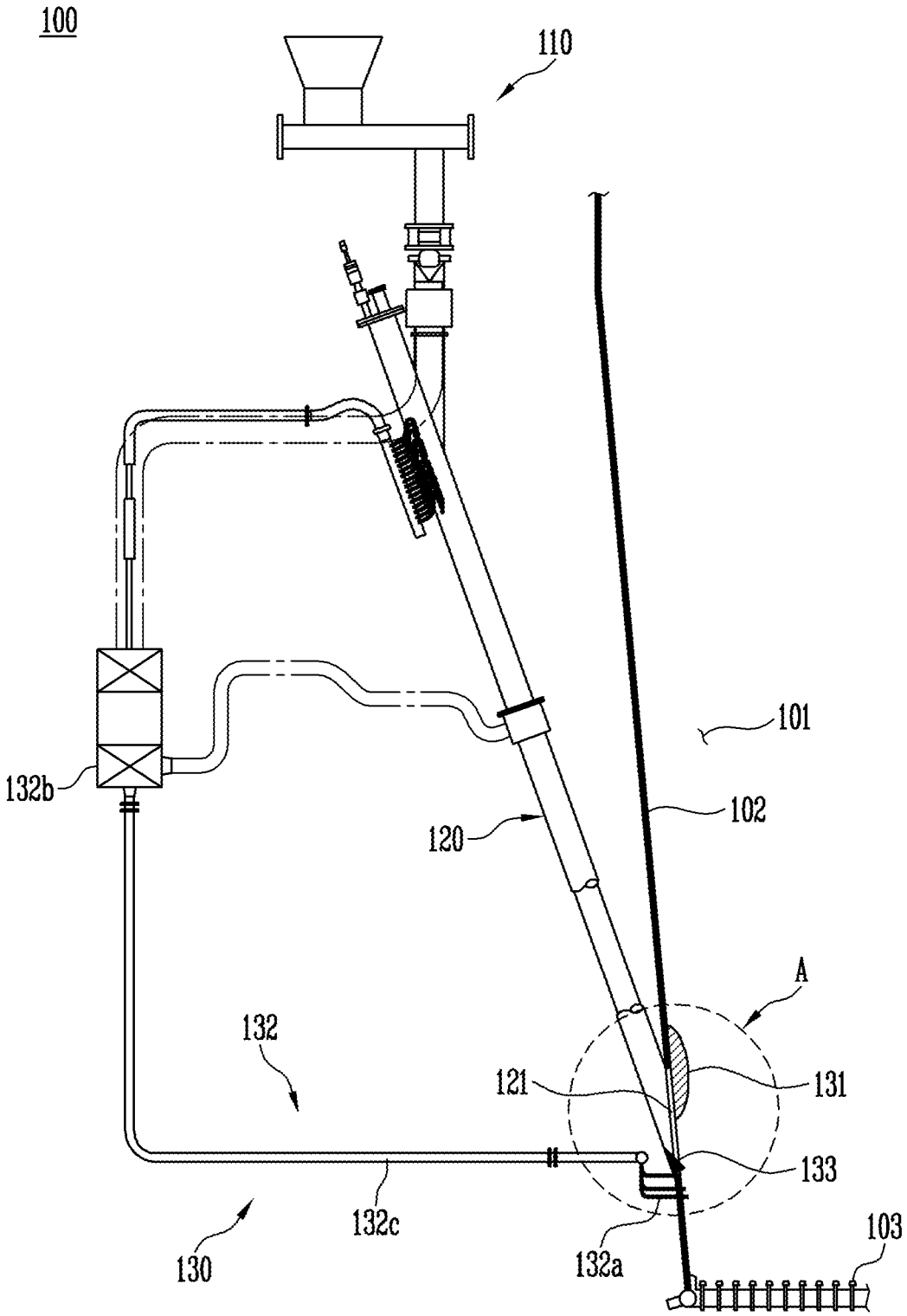
FIG. 3 is a conceptual view representing a fuel supply device of a circulating fluidized bed boiler in accordance with a second embodiment of the present invention.
Figure 4:
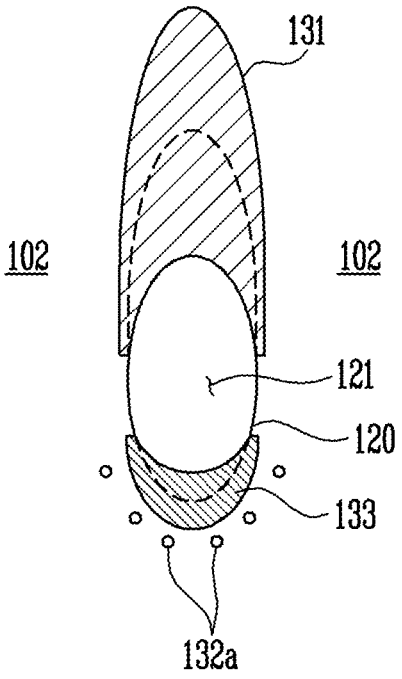
FIG. 4 is an enlarged side view of portion "A" shown in FIG. 3.

FIG. 3 is a conceptual view representing a fuel supply device of a circulating fluidized bed boiler in accordance with a second embodiment of the present invention. FIG. 4 is an enlarged side view of portion "A" shown in FIG. 3.

As shown in FIGS. 3 and 4, the fuel supply device 100 of the circulating fluidized bed boiler in accordance with the second embodiment of the present invention includes a feeder 110, a chute 120, and a combustion heat blocking part 130, and further includes a jump stand 133 as compared with the first embodiment.

The jump stand 133 may be installed at a sidewall 102 of a combustor 101 at a lower side of a fuel injection hole 121 of the chute 120 not only to allow heat of the high-temperature combustor 101 not to be transferred to the fuel injection hole 121 but also to allow fuel to be uniformly spread while being injected into the combustor 101 at an end of the fuel injection hole 121.

The jump stand 133 may be formed in the shape of a ski jump stand. The fuel injected into the combustor 101 is rapidly and uniformly spread into the combustor 101 at the jump stand 133, so that a phenomenon can be prevented, in which the fuel is melted and then stuck to a portion of the fuel injection hole 121.

In the above-described fuel supply device 100 of the circulating fluidized bed boiler in accordance with the first or second embodiment of the present disclosure, the combustion heat blocking part 130 may be configured with a combination of the heat shield plate 131 and the air nozzle part 132, a combination of the heat shield plate 131 and the jump stand 133, or a combination of the heat shield plate 131, the air nozzle part 132, and the jump stand 133.

As described above, in this embodiment, the heat shield plate 131 is configured with refractory for blocking high-temperature heat at an upper portion of the fuel injection hole 121 such that heat of the high-temperature combustor 101 is not transferred to the fuel injection hole 121 of the chute 120. Thus, the fuel injection hole 121 can be prevented from being clogged by fuel having a low melting point, which is melted by the heat of the high-temperature combustor 101, or combustion can be prevented from occurring at the end of the fuel injection hole 121 connected to the combustor 101 and in the fuel injection hole 121 due to back fire. Accordingly, continuous driving of the circulating fluidized bed boiler is possible, and degradation of availability can be prevented.

Also, in this embodiment, the air nozzle part 132 is further configured at a lower portion of the fuel injection hole 121 of the chute 120 such that the heat of the high-temperature combustor 101 is not transferred to the fuel injection hole 121. Thus, the fuel injection hole 121 can be further prevented from being clogged by fuel having a low melting point, which is melted by the heat of the high-temperature combustor 101, or combustion can be further prevented from occurring at the end of the fuel injection hole 121 connected to the combustor 101 and in the fuel injection hole 121 due to back fire. Accordingly, the continuous driving of the circulating fluidized bed boiler is possible, and the degradation of availability can be prevented.

Also, in this embodiment, the jump stand 133 is further configured at the lower portion of the fuel injection hole 121 of the chute 120 such that the heat of the high-temperature combustor 101 is not transferred to the fuel injection hole 121, to help fuel having a low melting point to be well-spread into the high-temperature combustor 101. Thus, a driving trouble of the circulating fluidized bed boiler can be prevented, and the efficiency of combustion can be improved.

Although the present invention has been described in connection with the embodiments, the embodiments of the present invention are only for illustrative purposes and should not be construed as limiting the scope of the present invention. It will be understood by those skilled in the art that various changes and modifications can be made thereto within the technical spirit and scope defined by the appended claims. Therefore, it should be understood that the technical contents related to the modification and application that can be easily derived from the embodiments of the present invention are included in the present invention.

The invention claimed is:

1. A fuel supply device of a circulating fluidized bed boiler, comprising:

a feeder transferring fuel;

a chute extending downwardly inclined from a lower end portion of the feeder to a combustor, the chute supplying the fuel to the combustor through a fuel injection hole; and a combustion heat blocking part provided at a portion of the fuel injection hole, the combustion heat blocking part preventing the fuel from being melted or burned at an end of the fuel injection hole connected to the combustor and in the fuel injection hole due to back fire, wherein the combustion heat blocking part includes a heat shield plate installed at a sidewall of the combustor at an upper side of the fuel injection hole, and wherein the heat shield plate has a shape which opens a lower semicircle of the fuel injection hole and covers an upper semicircle of the fuel injection hole.

2. The fuel supply device of claim 1, wherein the heat shield plate is formed in a dome shape or a fence shape having a downward slope along an edge of the upper semicircle of the fuel injection hole.

3. The fuel supply device of claim 1, wherein the combustion heat blocking part further includes air nozzle part installed at the sidewall of the combustor at a lower side of the fuel injection hole.

4. The fuel supply device of claim 3, wherein the air nozzle part includes:

a plurality of nozzles spraying cooling air into the combustor;

a compressor supplying the compressed high-pressure cooling air; and a pipe connecting the nozzles and the compressor to each other.

5. The fuel supply device of claim 4, wherein the plurality of nozzles are installed along the circumference of the lower end portion of the fuel injection hole of the chute connected to the combustor.

6. The fuel supply device of claim 1, wherein the combustion heat blocking part further includes a jump stand installed at the sidewall of the combustor at the lower side of the fuel injection hole, the jump stand allowing the fuel injected into the combustor to be spread.

* * * * *